United States Patent [19]

Haake

[11] 4,099,465

[45] Jul. 11, 1978

[54] IGNITION DEVICE FOR MISSILE MOTORS

[75] Inventor: Frederick L. Haake, Oxnard, Calif.

[73] Assignee: The United States of America as represented by the Secretary of the Navy, Washington, D.C.

[21] Appl. No.: 751,638

[22] Filed: Dec. 17, 1976

[51] Int. Cl.[2] ..... F42C 19/08

[52] U.S. Cl. ..... 102/204; 102/49.7

[58] Field of Search ..... 102/29, 49.7, 70, 86.5; 60/39.82 R, 256

[56] References Cited

U.S. PATENT DOCUMENTS

| | | | |
|---|---|---|---|
| 3,388,666 | 6/1968 | Walther | 102/49.7 |
| 3,971,319 | 7/1976 | Larson | 102/70 R |
| 4,027,592 | 6/1977 | Hubsch et al. | 102/86.5 |

FOREIGN PATENT DOCUMENTS

| | | | |
|---|---|---|---|
| 857,487 | 12/1960 | United Kingdom | 102/8 |

*Primary Examiner*—Verlin R. Pendegrass

*Attorney, Agent, or Firm*—Richard S. Sciascia; Joseph M. St. Amand; Darrell E. Hollis

[57] ABSTRACT

An ignition device for igniting a rocket motor comprising a striker adapted for displacement by pressure generated by an auxiliary charge, a percussion-operated priming device for impact by the striker, and an ignition charge for ignition by the priming device and for igniting the rocket motor. The striker, in its inoperative position, is mechanically keyed within a hollow container body having an axial bore therethrough by a pair of diametrically opposed circumferential grooves within which an O-ring is retained. For operation, a fluid generates pressure on the striker, thereby dislodging it from its mechanical keying and driving it to impact the percussion-operated priming device.

5 Claims, 2 Drawing Figures

IGNITION DEVICE FOR MISSILE MOTORS

BACKGROUND OF THE INVENTION

1. Field of the Invention

The present invention relates generally to ignition devices for rocket motors and more particularly to such ignition devices for the rocket motor of a missile.

2. Description of the Prior Art

As is generally well known in the art, missiles of the type designed for launching from aircraft are generally mechanically detached from the aircraft whereupon the rocket motor within the missile is then ignited such that the missile is then capable of flight under its own power. The rocket motor of the missile must be ignited by a device and it is to this ignition device that the present invention addresses itself.

It has been proposed that the ignition device be initiated electrically. Initiation is either instantaneous with or delayed until after mechanical detachment of the missile from the aircraft. This proposal can be unsatisfactory in that electrical initiation is susceptible to interference by radar systems leading to the possibility of preignition occurring either accidentally or deliberately by an enemy agency. In addition, the use of delayed electrical initiation necessitates the provision of an electrical supply within the missile, thereby producing additional weight and space problems.

It has also been proposed that the ignition device be initiated by a mechanical system, for example, by a clock-work device or the triggering of a spring-loaded plunger. Such mechanical systems, however, rely upon energy stored mechanically within the missile, for example, in the springs of the clock-work device or the spring of the spring-loaded plunger. Thus, these mechanical systems tend to be bulky and involve weight problems, and the inherent moving parts can stick or jam with only limited stored energy available to cause them to function. Thus, as well as creating weight and space problems, reliability is questionable.

The present invention, by using a pneumatic fluid to drive a striker to impact a percussion-operated priming device, provides an ignition device which overcomes the problems and disadvantages of the prior art devices discussed supra.

SUMMARY OF THE INVENTION

According to one embodiment of the present invention, an ignition device for igniting the rocket motor of a missile comprises a striker adapted for displacement by pressure generated by an auxiliary charge, a percussion-operated priming device for impact by the striker, and an ignition charge for ignition by the priming device and for igniting the rocket motor. The striker may be fluid-tightly slidably movable within a hollow container body of the device and retained in an inoperable position by mechanical keying comprising an O-ring retained within a pair of diametrically opposed circumferential grooves. The circumferential grooves being positioned on the striker and on the axial bore within the hollow container body.

Accordingly, one object of the present invention is to provide an ignition device for rocket motors of missiles.

Another object of the present invention is to increase efficiency and reliability.

A still further object of the present invention is to reduce space and weight.

Another object of the present invention is to increase safety.

A still further object of the present invention is to achieve a simplistic design.

Another object of the present invention is to provide an ignition device which is substantially mechanical and which has substantially no electrical components.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

DETAILED DESCRIPTION OF THE PREFERRED EMBODIMENT

Figure 1:
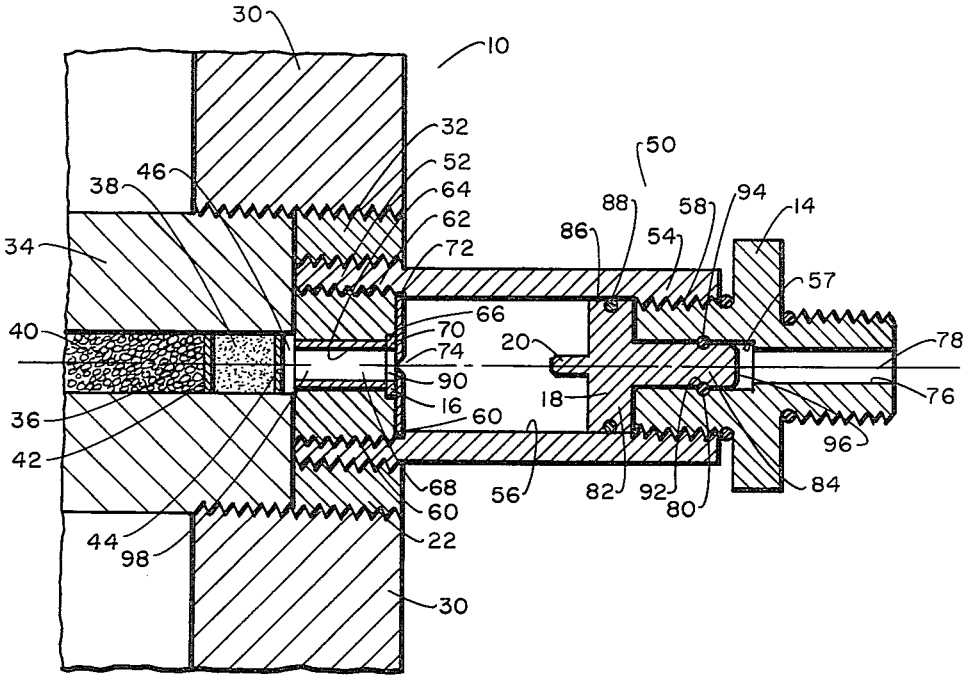
FIG. 1 is an actual cross-section of a front end portion of a rocket motor and illustrates a first embodiment of an ignition device mounted in said front end portion.

As shown in FIG. 1, ignition device 50 is held in its inoperative position by mechanical keying between striker retainer ring 14 and striker 18. The mechanical keying feature is comprised of diametrically opposed circumferential grooves 80 and 92 within which O-ring 94 is disposed.

For operation, a fluid enters opening 78 with sufficient pressure to dislodge striker 18 from its mechanical keying and drive axial projection 20 of striker 18 to impact percussion-operated priming device 68. Thereupon, priming device 68 fires, thus setting off a chain reaction which ignites the rocket motor.

Referring initially to FIG. 1, numeral 10 denotes generally the forward portion of a rocket motor comprising an end ring 30 engaged in the forward end of a tubular rocket motor casing, not shown. Igniter adapter ring 32 is screw threadably engaged within end ring 30.

Rearwardly of igniter adapter ring 32, fire holder ring 34 is screw threadably engaged in end ring 30. Fire holder ring 34 is axially bored to provide a cavity 36 therein which houses first fire 38 and second fire 40 separated by disc 42. Cavity 36 is sealed at cavity end 46 by seal 44. First fire 38 comprises a burning powder mixture such as an aluminum powder and oxidizer mixture. Second fire 36 comprises a plurality of pellets fabricated by compressing the powder of the material of the first fire into pellets. Disc 42 and cavity seal 44 are fabricated from thin frangible material such as annealed aluminum.

An ignition device of the embodiment of FIG. 1 is denoted generally by numeral 50 and is screw threadably engaged within igniter adapting ring 32 on screw threads 52.

The ignition device 50 comprises a hollow container body 54 having an axial bore 56 therethrough and screw threaded portions 58 and 60 at respective ends thereof.

Ring housing 62 is screw threadably engaged within the rear end of hollow container body 54 on screw threads 60. Ring housing 62 contains axial bores 64 and 66, thereby providing a cavity within which percussion-operated priming device 68 is disposed.

Percussion-operated priming device 68 comprises a 25-caliber center-fire shell devoid of its lead shot and propelling powder. Flange section 70 of percussion-operated priming device 68 is disposed within axial bore portion 66. Circular disc 72 having a hole 74 therein provides a means of rigidly affixing percussion-operated priming device 68 within axial bores 64 and 66. Hole 74 allows axial projection 20 to impact percussion-operated priming device 68. Circular disc 72 is fabricated from a solid, non-frangible material such as a metal.

Striker retainer ring 14 is screw threadably engaged within hollow container body 54 at the forward end thereof by screw threaded portion 58. Striker retainer ring 14 contains an axial bore 76 therethrough. Opening 78 of axial bore 76 is disposed to accept a pneumatic fluid supplied by the pneumatic fluid generator of FIG. 2.

A striker 18 is comprised of a mid-section portion 82, an axial projection 20 and an axial projection 84. Mid-section portion 82 is slidably engaged within axial bore 56. Mid-section portion 82 contains a circumferential groove 86 to receive an O-ring seal 88 for providing a fluid-tight seal between mid-section portion 82 of striker 18 and axial bore portion 56 of axial bore 76.

Axial projection 20 is suitably dimensioned to pass through opening 74 so as to strike cap 90 of percussion-operated priming device 68.

Axial projection 84 is suitably dimensioned to be slidably engaged within axial bore portion 57 of axial bore 76. Axial projection 84 contains circumferential groove 92 to receive O-ring 94. Axial bore portion 57 of axial bore 76 contains circumferential groove 80. Circumferential grooves 80 and 92 are disposed such that when striker 18 is in the position shown in FIG. 1, O-ring 94 rests within both grooves 92 and 80. In the inoperative condition of ignition device 50, striker 18 is positioned within axial bore portions 56 and 57 so that projection 20 is spaced a distance from opening 74 and striker 18 is mechanically keyed to striker retainer ring 14 by means of circumferential grooves 80 and 92 and O-ring 94.

Upon the application of an auxiliary launching charge through opening 78 to backside portion 96, capable of exerting sufficient pressure to dislodge striker 18 and O-ring 94 from groove 92, striker 18 will move forward with axial projection 20 passing through opening 74 and striking cap 90 of percussion-operated priming device 68.

Percussion-operated priming device 68 upon impact by striker 18, produces a flash or flame within cavity 98 shearing disc 44 and igniting first fire 38. First fire 38 then burns through disc 42, thus igniting second fire 40. In turn, second fire 40 ignites the rocket motor fuel elements (not shown).

It is noted that the auxiliary launching charge should be able to exert a pressure of typically 100 PSI and above to the back side 96 of striker 18 in order to dislodge striker 18 and O-ring 94 from groove 80, thus forcing axial projection 20 of striker 18 to impact cap 90 of percussion-operated priming device 68 with sufficient impact to fire percussion-operated priming device 68.

Figure 2:
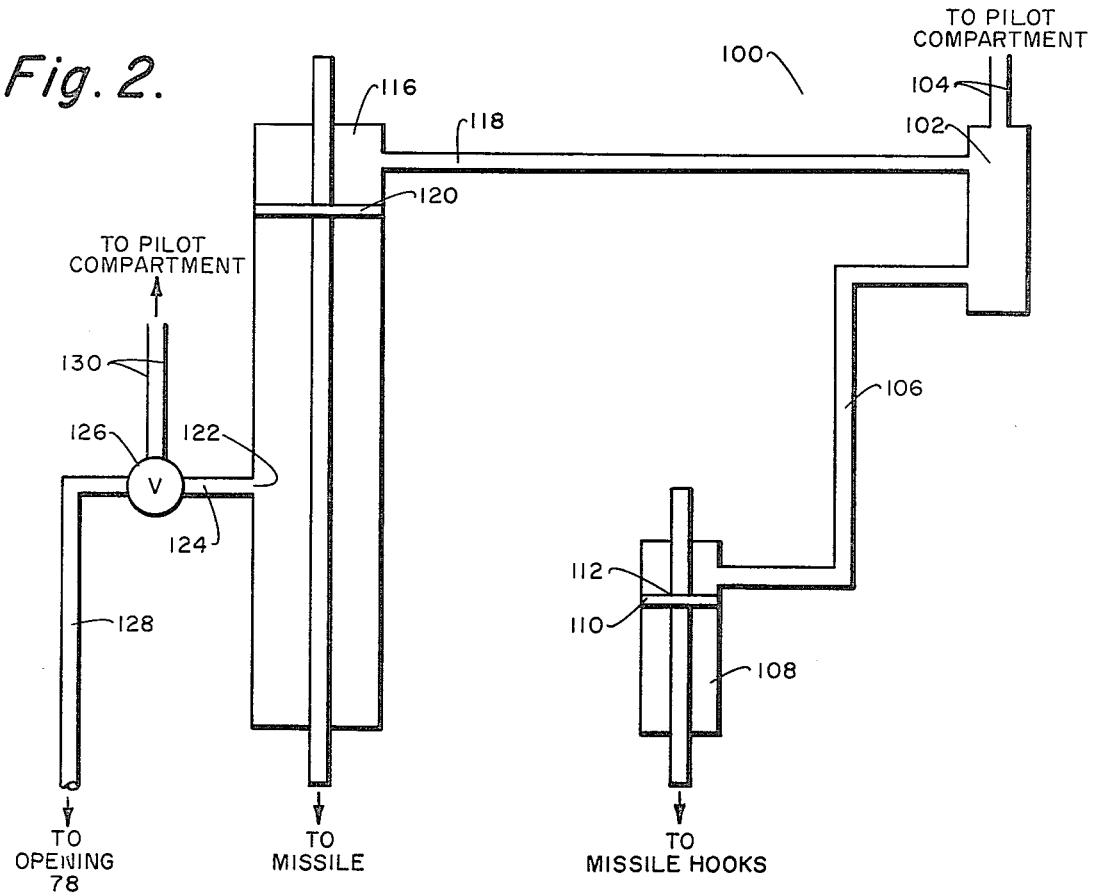
FIG. 2 is a schematic diagram of a pneumatic fluid supply system.

Now turning to FIG. 2, a means of providing a launching charge is illustrated. The launching charge generating means illustrated in FIG. 2 is denoted generally by the numeral 100. Launching charge generating means 100 comprises a gas pressure ignition cartridge 102 which is activated from the pilot compartment via lines 104. Upon activating gas pressure ignition cartridge 102, a gas is forced out along line 106 to gas chamber 108. Gas chamber 108 contains a piston 110. The gas in line 106 enters chamber 108, thereby imparting a force to the backside 112 of piston 110, thus forcing piston 112 downward within gas chamber 108. Piston 110 is mechanically linked to a launcher hook releasing mechanism (not shown) which grasps the missile (not shown), retaining the missile against the plane (not shown).

Thus, piston 110, as it is forced downward, releases the missile hooks from around the missile. At the same time, gas passes from gas pressure ignition cartridge 102 to gas chamber 116 via line 118. The gas imparts a downward movement to piston 120 which is mechanically connected to the missile, thereby ejecting the missile as piston 120 moves downward within gas chamber 116. It is noted that if the missile hooks do not release, the piston 120 will not move; i.e., the force imparted to the missile by piston 120 is not of sufficient magnitude to dislodge the missile unless the missile hooks are released.

When piston 120 passes opening 122, gas enters line 124. When solenoid valve 126 is opened, the gas passes through valve 124 into line 128. Line 128 is connected to opening 78 of FIG. 1. The pilot of the aircraft controls the opening and closing of solenoid valve 126 via line 130.

Thus, the missile is not ejected from the plane until the missile retaining hooks are released. In addition, the pilot is able to control the arming of the missile when the missile is launched. For example, if the pilot closes valve 126, then the missile will be launched without arming. However, if valve 126 is opened by the pilot prior to launching, then the missile is armed upon launching. The impact of axial projection 20 upon impact cap 90 of sufficient force to fire percussion-operated priming device 68 arms or ignites the rocket motor of the missile.

Obviously numerous modifications and variations of the present invention are possible in light of the above teachings. It is therefore to be understood that within the scope of the appended claims the invention may be practiced otherwise than as specifically described herein.

What is claimed is:

1. A pneumatic igniter firing adapter comprising:

a. a housing containing a percussion-operated priming device;

b. a hollow body having a first end cooperative with said housing such that said housing is connectable to said hollow body, said body having an axial bore therethrough;

c. striker means fluid tightly slidable along said bore for impacting said percussion-operated priming device, including:

1. a midsection suitably dimensioned to fluid-tightly slide along said axial bore within said hollow body wherein said midsection includes a circumferential groove for retaining an O-ring seal between said axial bore and said midsection, thereby effecting said fluid-tight seal;

2. a first axial projection suitably dimensioned to impact said percussion-operated priming device, said first projection being attached to said midsection;

3. a second axial projection attached to said midsection;

d. a striker retaining housing for retaining said striker means in an inoperable position by an O-ring mechanically keyed between said second axial projection of said striker means and said striker retaining housing, said striker retaining means having an axial bore therethrough; and e. means connected to said hollow body for supplying a fluid to the backside of said striker means, said fluid dislodging said striker means from its inoperative position and forcing said striker means to impact said priming device.

2. The apparatus of claim 1 wherein said housing further comprises a plate having an opening therein, said plate fixedly retaining said priming device within said housing, said striker having an axially extending projection suitably dimensioned for passing through said opening and impacting said priming device.

3. The apparatus of claim 1 wherein said priming device includes a center-fire 25 caliber shell devoid its lead projectile and propellant.

4. The apparatus of claim 1 wherein said axial bore is of smaller cross-sectional area through said striker retaining means than through said hollow body.

5. The apparatus of claim 1 wherein said fluid supply means is connected to said axial bore through said striker retaining member.

* * * * *